US011598580B2

(12) United States Patent
Ebner et al.

(10) Patent No.: US 11,598,580 B2
(45) Date of Patent: Mar. 7, 2023

(54) CONVECTION FURNACE

(71) Applicant: EBNER INDUSTRIEOFENBAU GMBH, Leonding (AT)

(72) Inventors: Robert Ebner, Leonding (AT); Ulrich Pschebezin, Ansfelden (AT); Manoj Kumar, Linz (AT); Andreas Sauschlager, Leonding (AT)

(73) Assignee: Ebner Industrieofenbau GmbH, Leonding (AT)

( * ) Notice: Subject to any disclaimer, the term of this patent is extended or adjusted under 35 U.S.C. 154(b) by 300 days.

(21) Appl. No.: 16/959,410

(22) PCT Filed: Jan. 15, 2019

(86) PCT No.: PCT/EP2019/050932

§ 371 (c)(1),
(2) Date: Jun. 30, 2020

(87) PCT Pub. No.: WO2019/138134

PCT Pub. Date: Jul. 18, 2019

(65) Prior Publication Data

US 2020/0340747 A1 Oct. 29, 2020

(30) Foreign Application Priority Data

Jan. 15, 2018 (DE) ..... 10 2018 100 745.0

(51) Int. Cl.
*F27B 17/00* (2006.01)
*F27D 7/04* (2006.01)
(Continued)

(52) U.S. Cl.
CPC ..... *F27B 17/0083* (2013.01); *F27D 3/0024* (2013.01); *F27D 7/04* (2013.01);
(Continued)

(58) Field of Classification Search
CPC .... F27B 17/0075; F27B 17/0083; F27B 5/14; F27B 5/16; F27D 11/02; F27D 2007/045; F27D 3/0024; F27D 7/04; F27D 99/007
(Continued)

(56) References Cited

U.S. PATENT DOCUMENTS 6,756,566 B2 * 6/2004 Moller ..... C21D 1/773 219/390
7,377,774 B2 5/2008 Katsumata et al.
(Continued)

FOREIGN PATENT DOCUMENTS

AT 319 310 B 12/1974
CN 101619427 A 1/2010
(Continued)

OTHER PUBLICATIONS

International Search Report of corresponding PCT/EP2019/050932, dated Mar. 27, 2019, with English translation, 8 pages.
(Continued)

*Primary Examiner* — Jessee R Roe
*Assistant Examiner* — Michael Aboagye
(74) *Attorney, Agent, or Firm* — Lewis Roca Rothgerber Christie LLP

(57) ABSTRACT

The present invention relates to a furnace device for heating a plate, in particular a metal plate, by convection. The furnace device has a housing, in which a temperature control region for temperature-controlling a component part and an adjustment region are formed, wherein the adjustment region has a temperature control device for adjusting a temperature of a temperature control fluid. Further, the furnace device has a positioning device for positioning the plate in the temperature control region in a predetermined orientation, and a ventilator, which is arranged in the housing and which is adapted to circulate the temperature control fluid in the housing between the temperature control region and the adjustment region such that the temperature control fluid is flowable in a flow direction along a surface of the plate.

17 Claims, 3 Drawing Sheets

(51) Int. Cl.

| | |
|---|---|
| ***F27D 11/02*** | (2006.01) |
| ***F27D 3/00*** | (2006.01) |
| *F27D 99/00* | (2010.01) |
| *F27D 19/00* | (2006.01) |

(52) U.S. Cl.
CPC ..... *F27D 11/02* (2013.01); *F27D 99/007* (2013.01); *F27D 2003/0046* (2013.01); *F27D 2007/045* (2013.01); *F27D 2019/0006* (2013.01); *F27D 2019/0018* (2013.01)

(58) Field of Classification Search
USPC ..... 219/92, 385, 390, 393, 391, 395; 373/111, 113, 119, 115, 117; 432/11, 18, 432/128, 77, 148
See application file for complete search history.

(56) References Cited

U.S. PATENT DOCUMENTS

| | | | | |
|---|---|---|---|---|
| 7,704,447 | B2 * | 4/2010 | Danger | F27B 9/39 432/128 |
| 9,082,796 | B2 * | 7/2015 | Probst | C23C 14/5866 |
| 2001/0051323 | A1 * | 12/2001 | Nishimura | F27B 9/029 432/128 |
| 2007/0257407 | A1 | 11/2007 | Danger et al. | |
| 2011/0183461 | A1 | 7/2011 | Probst | |
| 2012/0015476 | A1 | 1/2012 | Probst | |
| 2012/0171632 | A1 | 7/2012 | Novak et al. | |

FOREIGN PATENT DOCUMENTS

| | | | |
|---|---|---|---|
| DE | 10 2006 020 781 | B3 | 11/2007 |
| DE | 10 2009 037 299 | A1 | 8/2011 |
| DE | 10 2012 102 194 | A1 | 9/2013 |
| DE | 20 2016 105 838 | U1 | 12/2016 |
| EP | 0 483 596 | A1 | 5/1992 |
| EP | 1801529 | A1 | 6/2007 |
| EP | 2 144 026 | A1 | 1/2010 |
| JP | H11-125490 | A | 5/1999 |
| JP | 2000-274955 | A | 10/2000 |
| JP | 2001-012870 | A | 1/2001 |

OTHER PUBLICATIONS

Witten Opinion of corresponding PCT/EP2019/050932, dated Mar. 27, 2019, 9 pages.

* cited by examiner

CONVECTION FURNACE

REFERENCE TO RELATED APPLICATIONS

The present application is a national phase application derived from the international patent application no. PCT/EP2019/050932, filed Jan. 15, 2019, which in turn claims the benefits of the filing dates of the German patent application no. DE 10 2018 100 745.0, filed Jan. 15, 2018, all of which are incorporated herein by reference in their entireties.

TECHNICAL AREA

The present invention relates to a furnace device for heating a plate, in particular a metal plate, by convection. Furthermore, the present invention relates to a method for heating the plate, in particular a metal plate, by the furnace device.

BACKGROUND OF THE INVENTION

In many sectors of industry, such as the automotive industry, it is a concern to employ more lightweight component parts without having to dispense with sufficient stability. For this reason, lighter materials, such as aluminium or magnesium alloys, are used, because these have a high specific stability and rigidity.

In order to employ these advantageous lightweight materials, suitable forming (or shaping) processes are necessary to ensure an efficient forming. It has been found that a forming of a corresponding sheet metal (or sheet plate) at higher temperatures is advantageous. During the forming, in particular a temperature control region of 150° C. to 600° C. may be suitable.

In conventional heating technologies, the sheet metals and/or plates (or blanks) are heated directly with a burner (or torch), induction, infrared, a resistance heating or a contact heating. For example, when using a burner, there is the risk of the plates overheating quickly. With contact heating, different contact pressures of heating plates result in regions of the sheet metal with a faster heating, so that an uneven heating of the surface of the blanks also arises.

Other heating technologies, such as for example radiation heating, achieve low heat transfer coefficients and thus a slower heating of the plates. The heating efficiency is also low.

Presentation of the Invention

There may be a need to provide a furnace device, which is capable to heat plates (or blanks), in particular metal plates (or metal blanks) consisting of e.g. aluminium or magnesium, homogeneously and efficiently.

This need is satisfied with a furnace device for heating a plate and a method for heating a plate with the furnace device according to the subject matter of independent claims.

According to a first aspect of the present invention, there is described a furnace (or oven) device for heating a plate (or blank, or sheetbar), in particular a metal plate, by convection. The furnace device has a housing, in which a temperature control region for temperature controlling a component part (or component) and an adjustment region (or setting region) are formed, wherein the adjustment region has a temperature control device for adjusting (or setting) a temperature of a temperature control fluid. The furnace device further has a positioning device for positioning the plate in the temperature control region in a predetermined orientation (or alignment), and a ventilator (or fan), which is arranged in the housing and is adapted to circulate the temperature control fluid in the housing between the temperature control region and the adjustment region such that the temperature control fluid is flowable in a flow direction along a surface of the plate.

According to a further aspect of the present invention, there is described a method for heating a plate (or blank, or sheetbar), in particular a metal plate, by the furnace device described above. According to the method, a temperature of a temperature control fluid is adjusted (or set) by the temperature control device. The plate is positioned in the temperature control region in a predetermined orientation (or alignment) by the positioning device. The temperature control fluid is circulated in the housing between the temperature control region and the adjustment region such that the temperature control fluid flows in a flow direction along a surface of the plate.

The furnace (or oven) device may in particular be a stationary furnace, in which a batch of one plate or a plurality of plates may be heated to, held at or cooled to a desired temperature. A batch of plates may thus be placed in the temperature control region of the housing and may then be temperature-controlled to a desired temperature.

The plates (or blanks, or sheetbars) may in particular be similar component parts, which may be substantially undeformed and extend along a plane, in particular a horizontal plane. The plates may consist substantially of made of metal, and in particular of an aluminium or magnesium alloy.

The furnace device according to the present invention may operate in particular in the manner of a convection oven (or furnace), in which the temperature control fluid may circulate within the housing. Herein, the housing may have a temperature control region in which the plate may be temperature-controlled and an adjustment region (or setting region), in which the temperature control fluid may be heated or cooled to the desired temperature. The temperature control fluid may accordingly pass to the adjustment region and may then flow into the temperature control region for temperature-controlling the plate.

Herein, the furnace device according to the present invention may be formed in such a manner that the temperature control fluid may flow with a specific flow direction along a surface of the plate. The flow direction of the temperature control fluid and the orientation of the plate may be adjusted relative to each other in such a manner that the temperature control fluid may flow along the surface of the plate, in particular laminarly (or in laminar flow). This means that no impact jets may be used, in which the temperature control fluid may hit a surface of the plate substantially perpendicularly, but rather a lateral flow direction of the temperature control fluid relative to the plate may be set (or adjusted) so as to set a laminar flow along the surface of the plate.

Thus, an effective flow characteristic with low turbulence may be created within the housing, such that a circulation of the temperature control fluid within the housing may be adjusted effectively. Furthermore, the heating capacity of the temperature control fluid with respect to the plates may also be increased, since the circulation of the temperature control fluid may be adjustable accordingly. Due to the laminar flow of the temperature control fluid along the surface of the plate, a homogeneous temperature controlling of the plate may also be ensured.

In particular, the housing may be hermetically sealed from the environment such that the temperature control fluid may circulate without exchange with the environment of the housing. For example, air or inert gas may be used as a temperature control fluid. Furthermore, for example, additional chemical additives may be introduced into the temperature control fluid. Furthermore, the temperature control fluid may also contain liquid constituents and/or may have a vapour-like state.

After the plate may have been adjusted to a desired temperature by the furnace device, the plate may, for example, be supplied to a further temperature treatment, such as a temperature controlling or quenching process, or to a further forming process, such as a press (or molding press) or a press hardening (or in-mold hardening) tool.

The positioning device, for example, on which the plate may be supported, may serve for an exact orientation (or alignment) of the plate relative to the flow direction. The positioning device may, for example, be a fixed device, which may be provided in the temperature control region and on which at least one plate may be supported. Furthermore, the positioning device may be designed in such a manner that plural plates may be present side by side in one plane and/or that plural plates may be present one above the other and spaced at a distance from each other. Herein, a space may be provided between the respective plates such that the corresponding temperature control fluid may flow along the corresponding surfaces of the plates.

As is described further below, the positioning device may also be designed to be movable (or displaceable). For example, the positioning device may represent a movable positioning carriage, which may be moved into or out of the temperature control region through a corresponding first opening in the housing together with the plates supported on it. Furthermore, plural positioning devices may be provided, which may be moved into and out of the temperature control region in different planes (in particular vertically spaced planes) in order to temperature-control a plurality of plates along the different planes.

Furthermore, in an exemplary embodiment, the positioning device may have a roller conveyor and/or a haulage track (or conveyor track), along which the plates may be moved in a predefined orientation along the charging direction. The roller conveyor and/or haulage track may have drivable conveyor rollers such that the plates may move into and move out of the temperature control region, in particular along a charging direction.

According to a further exemplary embodiment, an angle of less than 30°, in particular less than 15°, may be present between the flow direction and the surface of the plate, such that the temperature control fluid may flows along the surface of the plate, in particular laminarly (or in laminar flow). In particular, the flow direction may be adjusted parallel to the surface of the plate. If there is a described small angle between the surface of the plate under the flow direction, impact jets may be prevented, which may result in turbulences and a disturbed flow pattern (or atmosphere). At a corresponding small angle of less than 30° and/or less than 15°, the temperature control fluid may not be rebounded after the striking on the surface of the plate, but may be slightly deflected and may flow laminarly along the surface of the plate. The flow direction may be set, for example, with the fluid guide elements described below. Alternatively, the ventilator may be arranged in front of the plate in such a manner that the specified flow direction of the temperature control fluid may be already flowing out from the ventilator.

According to a further exemplary embodiment, a fluid guide region may be formed in the housing between the temperature control region and the adjustment region, in which the temperature control fluid may be adjustable to the flow direction. The temperature control region and the adjustment region may be formed in the housing at different positions that may be spaced from each other. For example, the adjustment region may be above or below the temperature control region. The fluid guide region may represent the connecting region between the adjustment region and the temperature control region, wherein the fluid guide region may divert the temperature control fluid, which may exits from the adjustment region, in the flow direction. The fluid guide region may be formed, so to speak, along a circulation path of the temperature control fluid after the adjustment region and before the temperature control region.

According to a further exemplary embodiment, the furnace device may have at least one fluid guide element, which may be arranged in the housing, in particular in the fluid guide region, for guiding the temperature control fluid. The fluid guide element may be formed and arranged in such a manner that the temperature control fluid may be deflectable in the direction of the flow direction before the flowing along a surface of the plate. The fluid guide element may be made, for example, of a temperature-resistant material, such as for example metal. The fluid guide element may be a sheet-metal-shaped fluid guide element, which may, for example, be appropriately bent in order to guide and may divert the temperature control fluid on its surfaces. The fluid guide element may, together with a further fluid guide element that may be spaced at a distance or with a wall of the housing, form a corresponding flow channel, at the outlet of which the temperature control fluid may exit in the flow direction in the direction of the plate.

According to a further exemplary embodiment, a ventilator region may be formed in the housing between the temperature control region and the adjustment region, in which [ventilator region] the ventilator may be arranged for driving the flow fluid. The ventilator region may be formed, for example, along the circulation path of the temperature control fluid before the adjustment region and after the temperature control region. In this arrangement, the ventilator in the ventilator region may drive the temperature control fluid, which may have been cooled down in the temperature control region, again before it may enter the adjustment region.

According to a further exemplary embodiment, the furnace device further may have a partition wall (or dividing wall), which may be arranged in the housing in such a manner that in the temperature control region the temperature control fluid may flows along the flow direction, and that in a return region, which may be separated from the temperature control region by the partition wall, the temperature control fluid may flow opposite to the flow direction. The temperature control section may be located, for example, above or below the return region and may be separated from the return region by the partition wall. In the return region, for example, the ventilator region and/or the adjustment region with the temperature control device may be formed.

According to a further exemplary embodiment, the housing may have a first opening, through which the plate may be inserted into the temperature control region along a charging direction. The charging direction may describe the direction of the plates, along which they may be transported into and/or out of the temperature control region. The first opening may be closed selectively, for example, by a furnace door. Furthermore, as described below, the first opening may be sealed and/or closed by the positioning device itself.

According to a further exemplary embodiment, the positioning device and the first opening may be formed in such a manner that the charging direction may be perpendicular to the flow direction. Herein, the charging direction and the flow direction may, in particular within a common (in particular horizontal) plane, be perpendicular to each other. In this arrangement, the plate may be inserted directly through the first opening into the temperature control region without having to arrange devices for controlling the temperature control fluid, such as the adjustment region or the fluid guide region, between the first opening and the temperature control region, since the flow direction and/or the circulation path of the temperature control fluid may run perpendicular to the charging direction and/or past the first opening.

According to a further exemplary embodiment, the housing may have a second opening through which the plate may be movable out of the temperature control region, in particular along the charging direction. The second opening may be located in particular opposite to the first opening. In other words, the temperature control region may be located between the first opening and the second opening. Thus, a quick loading and/or charging of the plates may be enabled. While an already temperature-controlled plate may be moved out of the temperature control region through the second opening, a new batch and plates may already be inserted through the first opening. In this way, the loading time of the furnace device may be reduced and thus the efficiency increased.

If the positioning device may be designed as a haulage track (or conveyor track) or roller conveyor, it may guide the plates through the first opening into the temperature control region and out of the temperature control region through the opposite second opening. The furnace device may thus function in the manner of a continuous furnace and the plates may pass through the temperature control region in a predetermined orientation by the roller conveyor as a positioning device. The plates may be conveyed along the charging direction, and may be guided through the temperature control region, sequentially or continuously.

According to a further exemplary embodiment, the positioning device may be configured in a movable manner such that the plate may be movable from the environment of the housing through the first opening into and/or out of the temperature control region along the charging direction.

According to a further exemplary embodiment, the positioning device may have a charging fork, on which the plate may be placeable. The charging fork may have at least two or more spaced supporting rods, on which one or plural plates may be placeable. In particular, the supporting rods may be arranged parallel to each other. Reinforcing elements, such as cross braces, may be placeable between the supporting rods in order to increase the strength of the charging fork.

According to a further exemplary embodiment, the positioning device may form a support in the first opening of the housing, by which [support] the positioning device may be fixable to the housing. The positioning device may have, for example, a section which may be clamped in the first opening of the housing or which may, for example, be detachably fixed to the housing by a screw connection. The positioning device may then protrude from the first opening into the temperature control region of the housing in order to temperature-control the plates there accordingly.

In an exemplary embodiment, the positioning device may be supported exclusively in the first opening of the housing and may protrude from the first opening into the temperature control region without any further support points.

According to a further exemplary embodiment, the positioning device may have a sealing element, which may be movable with the positioning device. The sealing element may be formed in such a manner that in a position, in which the plate may be present in the temperature control region in a predetermined orientation, the sealing element may seal the first opening. For example, the sealing element may image a furnace door, which may be opened by a flange and/or collar. If the positioning device is located in the temperature control region, the sealing element may be present in the first opening in order to seal it.

According to a further exemplary embodiment, the positioning device may have a coupling region which is configured in such a manner that a gripping device may be coupleable thereto for moving the positioning device. The gripping device may represent a forklift or a crane, for example. The coupling region may have, for example, a clamping surface, to which the gripping device may be coupleable by corresponding clamping jaws. Furthermore, the coupling region may have, for example, corresponding bolt openings or the like for coupling to by the gripping device.

According to a further exemplary embodiment, the positioning device may have a haulage track (or conveyor track, and/or a roller conveyor, which may have rollers, along which the plates may be conveyed in the charging direction), which may be arranged within the temperature control region and may be configured in such a manner that the plate may be movable on the haulage track from the environment of the housing through the first opening into the temperature control region along the charging direction and/or movable out through the first opening or an opposite second opening of the housing. Thus, the furnace device may be operated in the manner of a continuous furnace and the plates may be moved into or out of the temperature control region sequentially or continuously.

According to a further exemplary embodiment, the furnace device further may have at least one further positioning device for positioning a further plate in the temperature control region in a further predetermined orientation such that the temperature control fluid may be flowable in the flow direction along a surface of the plate.

The further positioning device may, for example, be formed according to the positioning device described above.

According to a further exemplary embodiment, the housing may have a further first opening, through which the further plate may be introduceable into the temperature control region along the charging direction. The further positioning device may be inserted, for example, through the further first opening into the temperature control region. Furthermore, the further positioning device may be supported and fixed in the further first opening.

As an alternative to the further first opening, the positioning device and the further positioning device may be inserted into the temperature control region through a common first opening.

According to a further exemplary embodiment, the positioning device and the further positioning device may be arranged in the temperature control region in such a manner that the plate and the further plate may be arrangeable parallel to each other, in particular above each other. When the positioning device and the further positioning device are arranged vertically one above the other, the furnace device may thus be designed as a shelf furnace (or multiple hearth furnace). In this case, a large number of positioning devices, for example 4 to 6 positioning devices, may be arranged one above the other. The temperature control fluid may flow between the positioning devices such that the plates may be temperature-controlled on both surfaces.

Herein, the positioning devices may be formed according to the type of fork-shaped embodiment described above. The embodiment as a shelf furnace may be embodied also for an implementation of the positioning device as roller conveyors. For example, plural haulage tracks and/or roller conveyors may be arranged one above the other and each be guided between corresponding first openings and opposite second openings. Thus, plates may be guided along the corresponding haulage track through the temperature control region at plural levels (or tiers). The individual levels of the roller conveyors may be operated individually by a handling device (for example a crane or a robot arm).

According to a further exemplary embodiment, the furnace device furthermore may have a further partition wall, which may be arranged between the positioning device and the further positioning device in the temperature control region. Thus, the temperature control region may be divided into a first temperature control chamber, into which the positioning device may be movable, and into a second temperature control chamber, into which the further positioning device may be movable, by the further partition wall. The first temperature controlling chamber and the second temperature controlling chamber may each be embodied to be open at their respective inlet regions and outlet regions along the flow direction, such that the circulation path of the temperature control fluid may not be interrupted. The first temperature controlling chamber and the second temperature controlling chamber may be separated from each other, in particular in the vertical direction, by the partition wall, and may be sealed from each other at least in the vertical direction.

According to a further exemplary embodiment, the furnace device may have a further fluid guiding element, which may be arranged in the housing for guiding the temperature control fluid, wherein the further fluid guiding element may be formed and arranged in such a manner that the temperature control fluid may be deflectable in the flow direction before the flowing along a further surface of the further plate. By the further fluid guide element, a part of the temperature control fluid may also be directed in the direction towards the further plate in order to temperature-control it.

According to a further exemplary embodiment, the temperature control device may have an electrical heating register (or heater coils). The electrical heating register may thus be passed by the temperature control fluid such that it may be heated. Alternatively or additionally, the temperature control device may also have a radiation heating, an infrared heating, or a resistance heating.

With the furnace device according to the invention, a shelf furnace having plural vertically superimposed positioning devices may thus be provided. For example, each positioning device may be moved in through a corresponding first opening in the housing on one side. A sealing element and/or a furnace door may be arranged at the positioning device in order to close the first opening tightly.

It is noted that the embodiments described herein may represent only a limited selection of possible embodiment variants of the invention. It may thus be possible to combine the features of individual embodiments in a suitable manner, such that a large number of different embodiments may have to be considered as obviously disclosed to the person skilled in the art with the embodiment variants explicitly mentioned herein. In particular, some embodiments of the invention may be described with apparatus claims and other embodiments of the invention may be described with method claims. However, it may immediately become clear to the person skilled in the art when reading this application that, unless explicitly stated otherwise, in addition to a combination of features, which may belong to one type of inventive subject-matter, any combination of features, which may belong to different types of inventive subject-matter, may also be possible.

BRIEF DESCRIPTION OF THE DRAWINGS

For a further explanation and a better understanding of the present invention, embodiment examples are described in more detail below with reference to the attached drawings, in which.

DETAILED DESCRIPTION OF EXEMPLARY EMBODIMENTS

Figure 1:
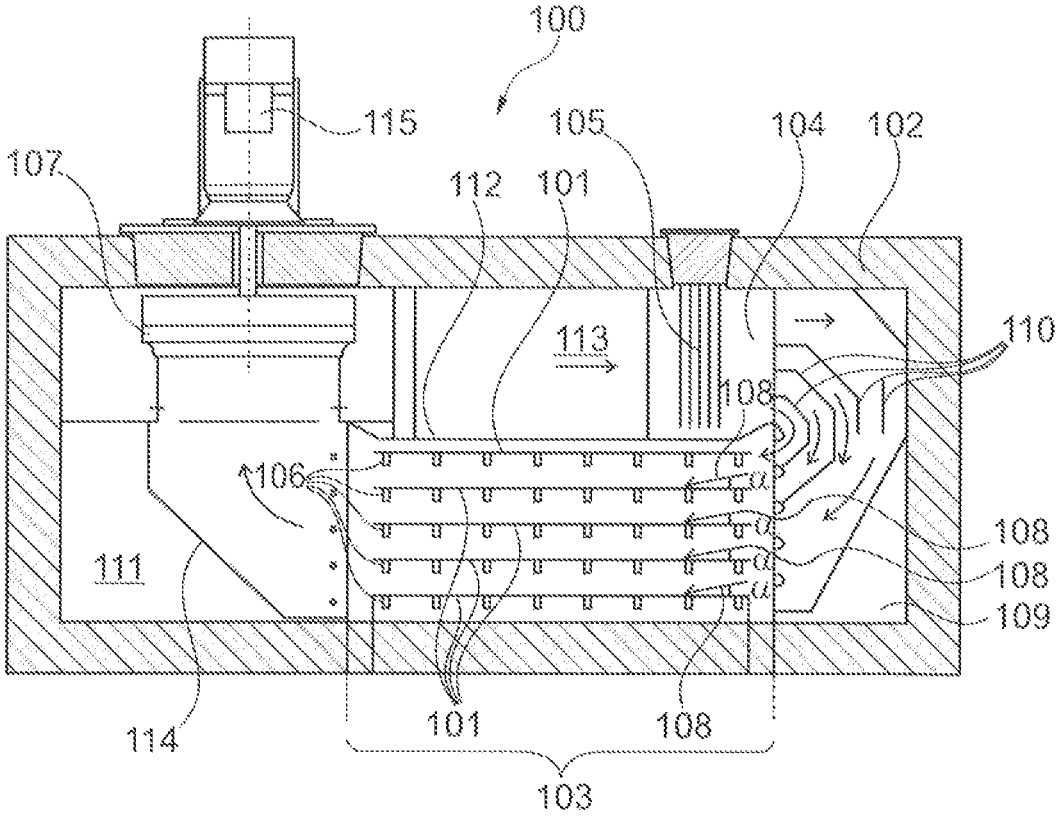
FIG. 1 is a schematic illustration of a furnace device according to an exemplary embodiment of the present invention.

Same or similar component parts in different figures are provided with the same reference numerals. The illustrations in the figures are schematic.

Figure 2:
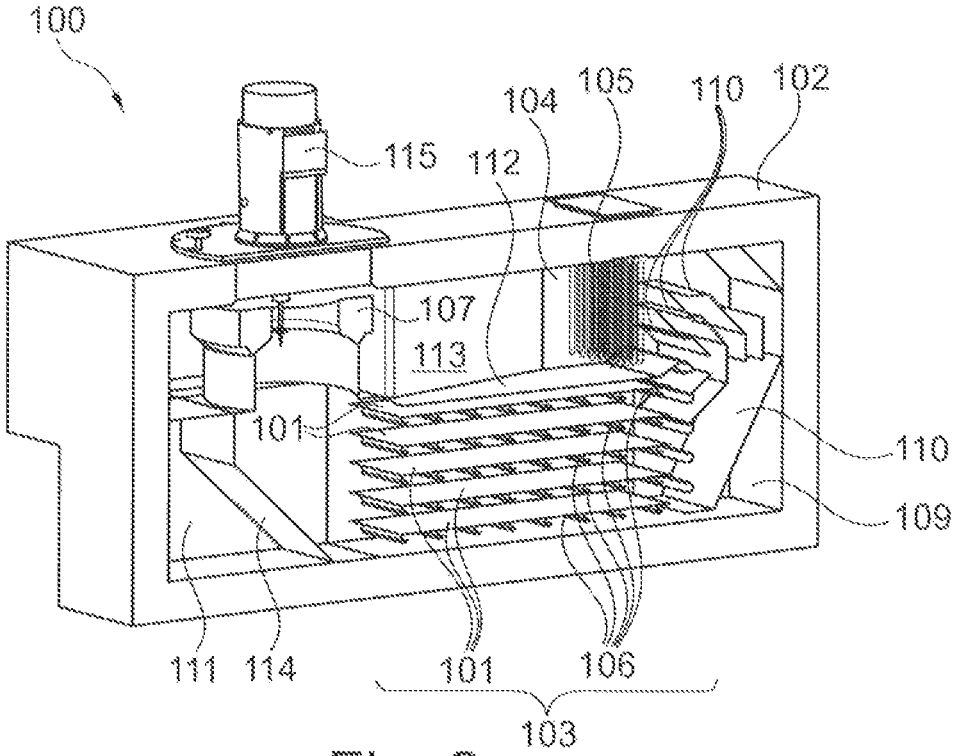
FIG. 2 is a perspective view of the furnace device from FIG. 1.

FIG. 1 shows a schematic illustration of a furnace device 100 according to an exemplary embodiment. FIG. 2 shows a perspective illustration of the furnace device from FIG. 1 The present invention may relate to a furnace device 100 for heating a plate 101, in particular one or plural metal plates 101, by convection. The furnace device 100 may have a housing 102, in which a temperature control region 103 for temperature-controlling a component part and an adjustment region 104 may be formed, wherein the adjustment region 104 may have a temperature control device 105 for adjusting a temperature of a temperature control fluid. Further, the furnace device 100 may have a positioning device 106 for positioning the plate 101 in the temperature control region 103 in a predetermined orientation, and a ventilator 107, which may be arranged in the housing 102 and may be adapted to circulate the temperature control fluid in the housing 102 between the temperature control region 103 and the adjustment region 104 such that the temperature control fluid may be flowable in a flow direction 108 along a surface of the plate 101.

The furnace device 100 may be in particular a stationary furnace, in which a batch of plates 101 may be heated to, held at or cooled to a desired temperature. A batch of plates 101 may thus be placed in the temperature control region 103 of the housing 102 and subsequently temperature-controlled to a desired temperature.

The furnace device 100 may work in particular according to the type of a convection furnace, in which the temperature control fluid may circulate inside the housing 102. The housing 102 may have a temperature control region 103, in which the plate 101 may be temperature-controlled, and an adjustment region 104, in which the temperature control fluid may be heated or cooled to the desired temperature. The temperature control fluid may accordingly pass to the adjustment region 104 and may then flow into the temperature control region 103 for temperature-controlling the plate 101. In the adjustment region a temperature control device 105, which may represent for example an electrical heating register, may be provided in order to bring the temperature control fluid again to a desired temperature.

The furnace device 100 may be designed in such a manner that the temperature control fluid may flow with a specific flow direction 108 along a surface of the plate 101. The flow direction 108 of the temperature control fluid as well as the orientation of the plate 101 may be adjusted relative to each other in such a manner that the temperature control fluid may flow along the surface of the plate 101, in particular in laminar flow.

After the plate 101 may have been adjusted to a desired temperature by the furnace device 100, the plate 101 may, for example, be supplied to a further temperature treatment, such as for example a temperature controlling or quenching process, or to a further forming process, such as a press or a press hardening tool (or in-mold hardening tool).

The positioning device 106, on which the plate 101 may be supported, may be used for the exact orientation (or alignment) of the plate 101 relative to the flow direction. In the embodiment example from FIG. 1 and FIG. 2, there are shown 5 positioning devices 106 one above the other, each of which may be designed as charging fork 301 (see FIG. 3). A distance may be provided between the respective plates 101 such that the corresponding temperature control fluid may flow along the corresponding surfaces of the plates 101.

The positioning devices 106 may be moved into and out of the temperature control region 103 in different vertically spaced levels in order to temperature-control a plurality of plates 101 along the different levels.

Between the flow direction 108 and the surface of the plate 101 there may be an angle $\alpha$ of less than 30°, in particular of less than 15°, such that the temperature control fluid may flow, in particular laminarly, along the surface of the plate 101. In particular, the flow direction may be adjusted parallel to the surface of the plate 101. If there is a small angle $\alpha$ between the surface of the plate 101 under the flow direction 108, impact jets may be prevented, which may result in turbulences and a disturbed flow pattern.

In the housing 102, a fluid guide region 109 may be formed between the temperature control region 103 and the adjustment region 104, in which the temperature control fluid may be adjustable to the flow direction 108. The temperature control region 103 and the adjustment region 104 may be arranged in the housing 102 one above the other. The fluid guide region 109 may represent the connecting region between the adjustment region 104 and the temperature control region 103, wherein the fluid guide region 109 may divert the temperature control fluid, which may exit from the adjustment region 104, in the flow direction 108. The fluid guide region 109 may be formed, so to speak, along a circulation path of the temperature control fluid after the adjustment region 104 and before the temperature control region 103.

In particular, fluid guide elements 110 may be arranged in the fluid control area 109 for guiding the temperature control fluid. A fluid guide element 110 may be formed and arranged in such a manner that the temperature control fluid may be deflectable in the direction of the flow direction 108 before the flowing along a surface of the plate 101. The fluid guide element 110 may be a sheet-metal-shaped fluid guide element, which may, for example, be appropriately bent in order to guide and divert the temperature control fluid on its surfaces. The fluid guide element 110 may [together] with a spaced-apart further fluid guide element 110 or with a wall of the housing 102 form a corresponding flow channel, at the outlet of which the temperature control fluid may exit in the flow direction 108 in the direction towards the plate 101.

The housing 102 may have a ventilator region 111 between the temperature control region 103 and the adjustment region 104, in which the ventilator 107 may be arranged for driving the flow fluid. For example, the ventilator region 111 may be formed along the circulation path of the temperature control fluid before the adjustment region 104 and after the temperature control region 103. In this arrangement, the ventilator 107 in the ventilator region 111 may drive the temperature control fluid, which may have been cooled down in temperature control region 103, again before it may enter the adjustment region 104 and may be led to the corresponding temperature control device 105. In the ventilator region 111, additional return baffles 114 may be provided, which may divert the temperature control fluid to the ventilator 107.

The furnace device 100 further may have a partition wall 112, which may be arranged in the housing 102 in such a manner that in the temperature control region 103 the temperature control fluid may flow along the flow direction and in a return section 113, which may be separated from the temperature control region 103 by the partition wall 112, the temperature control fluid may flow opposite to the flow direction 108. The temperature control section 103 may be arranged below the return region 113 and separated from the return region 113 by the partition wall 112. In the return region 113, for example, the adjustment region 104 with the temperature control device 105 may be formed.

A plurality of fluid guide elements 110 may be arranged in the fluid guide region 109, which may deflect the temperature control fluid in the direction of the flow direction 108 before the flowing along a corresponding surface of the corresponding plate 101.

The temperature control device 105 may have an electrical heating register (or heater coils). The electrical heating register may thus be passed by the temperature control fluid such that the latter may be heated.

Furthermore, a fluid inlet may be provided in the housing 102, in particular in the ventilator region 107, such that a temperature control fluid may be introduced from the surroundings into the interior of the housing 102 through the fluid inlet. For example, air or an inert gas may be introduced. The fluid inlet 115 may be closed selectively.

Figure 3:
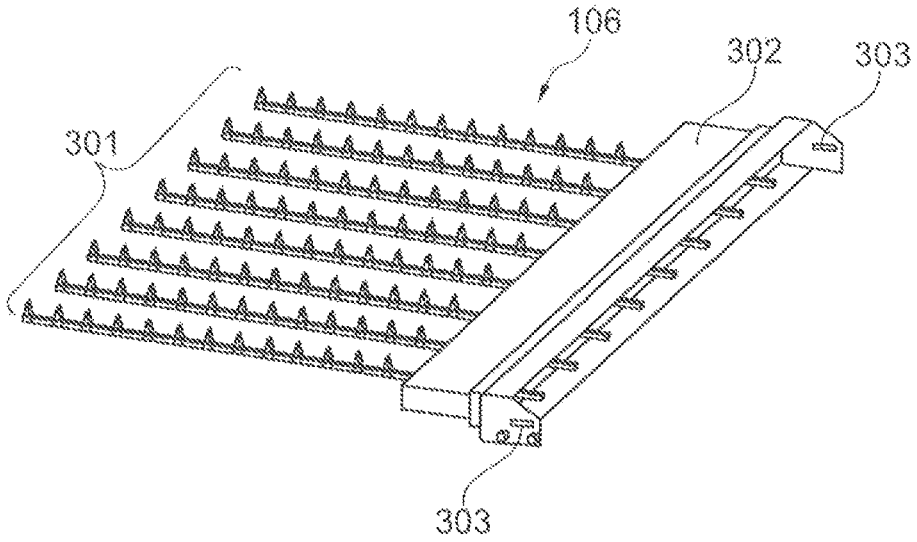
FIG. 3 is a schematic illustration of a charging fork according to an exemplary embodiment of the present invention.

FIG. 3 shows a schematic illustration of a charging fork 301 as a positioning device 106. At least one plate 101 may be placeable on the charging fork 301. The charging fork 301 may have at least two or more spaced support rods, on which one or plural plates 101 may be placeable. The support bars may be arranged in particular parallel to each other. Reinforcing elements, such as cross braces, may be arranged between the support bars in order to increase the stability of the charging fork.

Furthermore, the support rods may be surrounded at their free end by a sealing element 302. The sealing element 302 may be provided in order to close a corresponding first opening 401 (see FIG. 4). The sealing element 302 may act as a furnace door, so to speak. Furthermore, the sealing element 302 may form a circumferential flange, which may run around the free ends of the corresponding support rods of the charging fork 301. The circumferential flange may be used to be fixed in a first opening 401 of the housing 102, for example by a press connection or by a releasable screw connection. Thus, in an exemplary embodiment, the sealing element 302 may simultaneously contribute to the formation of a support of the positioning device 106.

Furthermore, the positioning device 106 may have a coupling region 303, which may be configured in such a manner that a gripping device may be coupleable thereto for moving (or displacing) the positioning device 106. The coupling region 303 may have, for example, a clamping surface, to which the gripping device may be coupled by corresponding clamping jaws. Furthermore, the coupling region 303 may have, for example, corresponding bolt openings or the like for coupling the gripping device thereto.

Figure 4:
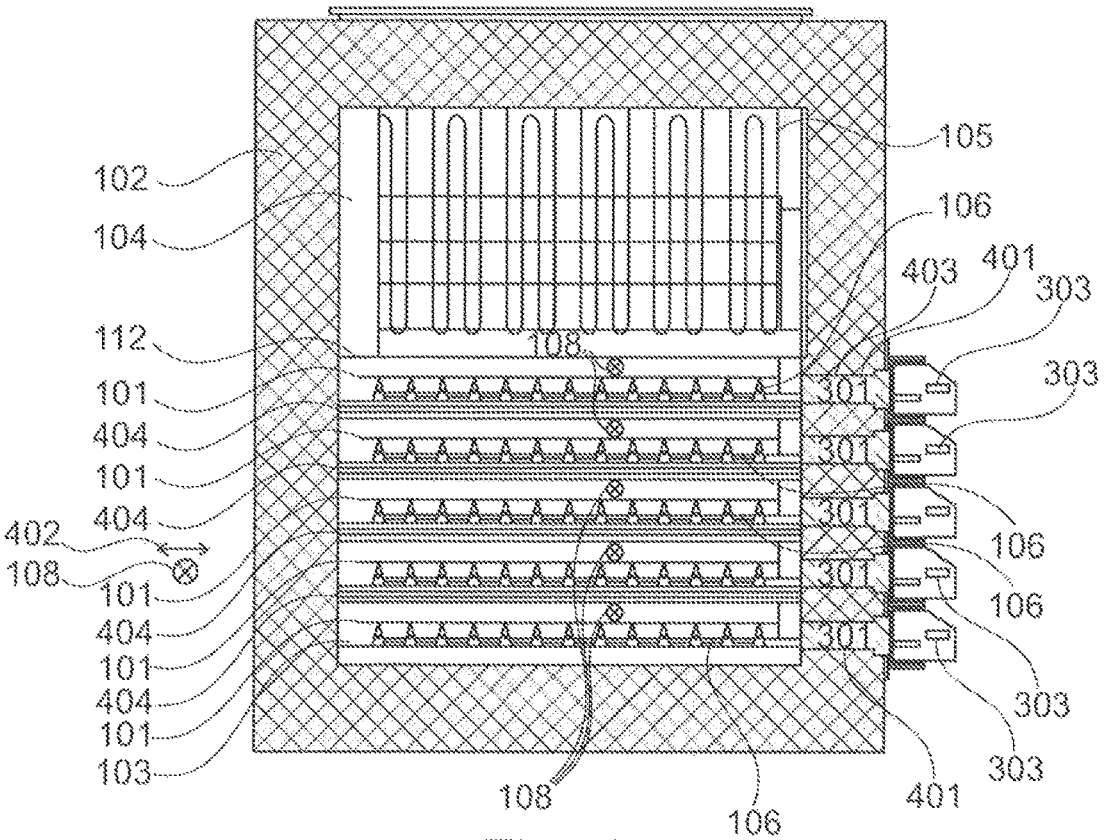
FIG. 4 is a schematic illustration, in side view, of a furnace device according to an exemplary embodiment of the present invention.

FIG. 4 shows a furnace device 100, for example from FIG. 1 in a side view. The housing 102 may have first openings 401, through which the plates 101 are introduceable into the temperature control region 103 along a charging direction 402. The charging direction 402 may describe the direction of the plates 101, along which the latter may be transported into and out of the temperature control region 103, in particular by the corresponding positioning devices 106. The first openings 401 may, for example, be closed selectively by a furnace door. Furthermore, the first openings 401 may be sealed or closed by the corresponding sealing elements 302 of the positioning devices 106.

The positioning devices 106 and the first openings 401 may be embodied in such a manner that the charging direction 402 may be present perpendicular to the flow direction 108. The charging direction 402 and the flow direction 108 may be perpendicular to each other, in particular within a common (in particular horizontal) plane. In this arrangement, the plate 101 may be inserted into the temperature control region 103 directly through the first opening 401 without having to arrange devices for controlling the temperature control fluid between the first opening 401 and the temperature control region 103, since the flow direction 108 and/or the circulation path of the temperature control fluid may run perpendicular to the charging direction 402 and/or past the first opening 401.

In the embodiment example from FIG. 4, the positioning devices 106 may form supports 403 in the respective first openings 401 of the housing 102, by which [supports] the positioning devices 106 may be fixable to the housing 102. The positioning devices 106 may have, for example, sections (for example the sealing element 302), which may be clamped in the respective first opening 401 of the housing 102 or which may, for example, be detachably fixed to the housing 102 by a screw connection. In this way, a firm clamping of the positioning device 106 in the respective first opening 401 may be established. From the respective first openings 401, the positioning devices 106 may then protrude into the temperature control region 103 of the housing 102 in order there to temperature-control the plates 101 accordingly.

The positioning devices 106 may be supported exclusively in the respective first openings 401 of the housing 102, and may protrude from the respective first opening 401 into the temperature control region 103 without any further support points.

Furthermore, the positioning devices 106 may be arranged in the temperature control region 103 in such a manner that the plates 101 may be arranged parallel to each other and in particular one above the other. In the arrangement of the positioning devices 106 being arranged vertically one above the other, the furnace device 100 may thus be designed as a shelf furnace. The temperature control fluid may flow between the positioning devices 106 such that the plates 101 may be temperature-controlled on their respective two surfaces.

The furnace device 100 may furthermore have further partition walls 404 in the temperature control region 103, which may be arranged between the positioning devices 106. Thus, the temperature control region 103 may be divided into temperature control chambers by the further partition walls 404, into which the positioning devices 106 may be movable. The further partition walls 404 may extend, for example, from one side wall of the housing 102, in which the first openings 401 may be formed, to an opposite side wall of the housing 102. In particular, the further partition walls 404 may extend along the charging direction 402. The formed temperature control chambers may each be embodied to be open at their respective inlet regions and outlet regions along the flow direction 108, such that the circulation path of the temperature control fluid may not be interrupted.

Figure 5:
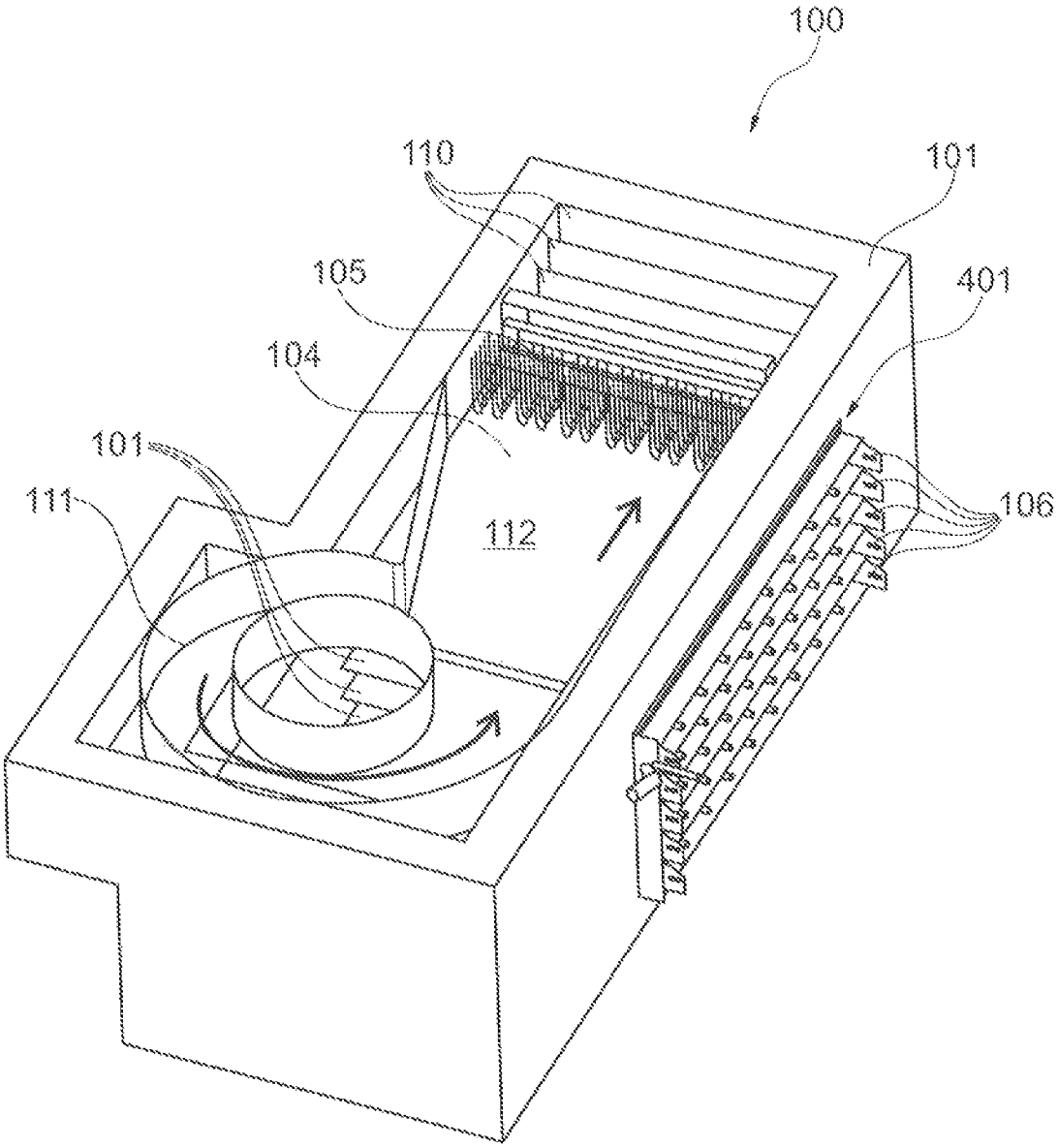
FIG. 5 is a top view of a furnace device according to an exemplary embodiment.

FIG. 5 shows a top view of a furnace device 100 according to an exemplary embodiment. The upper adjustment region 104, in which the temperature control device 105 may be located, may be separated from the temperature control region 103 lying therebelow by the partition wall 112. The first openings 401, through which the positioning devices 106 may be retracted, may be formed on a side wall of the housing 102. Furthermore, the ventilator range 111 is shown, in which the temperature control fluid may be driven and directed in the direction towards the adjustment region 104.

Supplementarily, it is noted that "having" does not exclude other elements or steps and "a" or "an" does not exclude a plurality. Furthermore, it should be noted that features or steps, which have been described with reference to one of the above embodiment examples, can also be used in combination with other features or steps of other embodiment examples, which have been described above. Reference numerals in the claims are not to be considered as a limitation.

LIST OF REFERENCE NUMERALS

100 furnace device
101 plate
102 housing
103 temperature control region
104 adjustment region
105 temperature control device
106 positioning device
107 ventilator
108 flow direction
109 fluid guide region
110 fluid guide element
111 ventilator region
112 partition wall
113 return region
114 return baffle
115 fluid inlet
301 charging fork
302 sealing element
303 coupling region
401 first opening
402 charging direction
403 support
404 further partition wall
$\alpha$ angle

The invention claimed is:

1. A furnace device for heating a plate by convection, the furnace device having:

a housing, in which a temperature control region for temperature-controlling a component part and an adjustment region are formed, wherein the housing has a first opening through which the plate is introducible into the temperature control region along a charging direction, wherein the adjustment region has a temperature control device for adjusting a temperature of a temperature control fluid, a charging fork for positioning the plate in the temperature control region in a horizontally lying orientation, wherein the charging fork has a sealing member, wherein the sealing member is formed in such a manner that in a position, at which the plate is in the horizontally lying orientation in the temperature control region, the sealing member seals the first opening, and a ventilator, which is arranged in the housing and which is adapted to circulate the temperature control fluid in the housing between the temperature control region and the adjustment region in such a manner that the temperature control fluid is flowable in a flow direction along a surface of the plate.

2. The furnace device according to claim 1, wherein an angle, $\alpha$, of less than 30°, is present between the flow direction and the surface of the plate, in such a manner that the temperature control fluid flows laminarly along the surface of the plate.

3. The furnace device according to claim 1, wherein a fluid guide region is formed in the housing between the temperature control region and the adjustment region, in which fluid guide region the temperature control fluid is adjustable to the flow direction, wherein the furnace device further has a fluid guide element, which is arranged in the housing, for guiding the temperature control fluid, wherein the fluid guide element is formed and arranged in such a manner that the temperature control fluid is deflectable in the flow direction before flowing along a surface of the plate.

4. The furnace device according to claim 1, wherein a ventilator region is formed in the housing between the temperature control region and the adjustment region, in which ventilator region the ventilator for driving the flow fluid is arranged.

5. The furnace device according to claim 1, further having a partition wall, which is arranged in the housing in such a manner that the temperature control fluid flows along the flow direction in the temperature control region and the temperature control fluid flows opposite to the flow direction in a return region, which is separated from the temperature control region by the partition wall.

6. The furnace device according to claim 1, wherein the charging fork and the first opening are formed in such a manner that the charging direction is perpendicular to the flow direction.

7. The furnace device according to claim 1, wherein the housing has a second opening through which the plate is movable out of the temperature control region along the charging direction.

8. The furnace device according to claim 1, wherein the charging fork is configured displaceably in such a manner that the plate is movable into and/or is movable out of the environment of the housing through the first opening into the temperature control region along the charging direction.

9. The furnace device according to claim 8, wherein the charging fork forms a support in the first opening of the housing, by which support the positioning device is fixable to the housing.

10. The furnace device according to claim 8, wherein the charging fork has a coupling region, which is configured in such a manner that a gripping device for moving the charging fork is couplable thereto.

11. The furnace device according to claim 1, wherein the charging fork has a conveyor path, which is arranged within the temperature control region and which is configured in such a manner that the plate is movable into and/or is movable out of the temperature control region on the conveyor path along the charging direction from the environment of the housing through the first opening.

12. The furnace device according to claim 1, further having at least one further charging fork for positioning a further plate in the temperature control region in a further predetermined orientation such that the temperature control fluid is flowable in the flow direction along a surface of the further plate, wherein the housing has a further first opening, through which the further plate is introducible into the temperature control region along the charging direction.

13. The furnace device according to claim 12, wherein the charging fork and the further charging fork are arranged in the temperature control region in such a manner that the plate and the further plate are arrangeable parallel to each other.

14. The furnace device according to claim 12, further having a further partition wall, which is arranged between the charging fork and the further charging fork in the temperature control region.

15. The furnace device according to claim 12, further having a further fluid guide element, which is arranged in the housing for guiding the temperature control fluid, wherein the further fluid guide element is formed and arranged in such a manner that the temperature control fluid is deflectable in the flow direction before the flowing along a further surface of the further plate.

16. The furnace device according to claim 1, wherein the temperature control device has an electrical heating register.

17. A method for heating a blank by the furnace device according to claim 1, the method comprising:

adjusting a temperature of a temperature control fluid by the temperature control device, positioning the blank in the temperature control region in a predetermined horizontal orientation by the charging fork, and circulating the temperature control fluid in the housing between the temperature control region and the adjustment region such that the temperature control fluid flows in a flow direction along a surface of the blank.

* * * * *